US008209896B1

(12) United States Patent
Cashwell

(10) Patent No.: US 8,209,896 B1
(45) Date of Patent: Jul. 3, 2012

(54) MULTI-PURPOSE GUNSMITHING FIXTURE

(76) Inventor: Kenneth W. Cashwell, Virginia Beach, VA (US)

( * ) Notice: Subject to any disclaimer, the term of this patent is extended or adjusted under 35 U.S.C. 154(b) by 347 days.

(21) Appl. No.: 12/655,947

(22) Filed: Jan. 11, 2010

Related U.S. Application Data

(60) Provisional application No. 61/204,762, filed on Jan. 9, 2009.

(51) Int. Cl.

| | |
|---|---|
| ***F41A 23/18*** | (2006.01) |
| ***F41C 27/00*** | (2006.01) |
| ***B25B 11/00*** | (2006.01) |
| ***B23Q 3/18*** | (2006.01) |

(52) U.S. Cl. ..... 42/94; 42/90; 206/317; 269/47; 269/303

(58) Field of Classification Search ..... 42/85, 90, 42/94; 206/317; 248/671; 269/47, 289 R, 269/303, 315

See application file for complete search history.

(56) References Cited

U.S. PATENT DOCUMENTS

| | | | | |
|---|---|---|---|---|
| 499,315 | A * | 6/1893 | Borchardt | 89/132 |
| 923,915 | A * | 6/1909 | Wesson | 269/47 |
| 3,225,656 | A * | 12/1965 | Flaherty et al. | 89/37.04 |
| 4,055,017 | A * | 10/1977 | Thompson | 42/94 |
| 4,841,839 | A * | 6/1989 | Stuart | 89/37.04 |
| 5,111,608 | A * | 5/1992 | Weisheit | 42/90 |
| 5,937,561 | A * | 8/1999 | Abernethy | 42/94 |
| 2006/0218840 | A1 * | 10/2006 | Cauley | 42/94 |
| 2008/0047188 | A1 * | 2/2008 | Lindstrom | 42/94 |
| 2009/0026679 | A1 * | 1/2009 | Harman, III | 269/43 |

* cited by examiner

*Primary Examiner* — Bret Hayes
(74) *Attorney, Agent, or Firm* — Wooten & Shaddock, PLC

(57) ABSTRACT

A gunsmithing fixture for use with an upper receiver, including an upper portion having an upper body portion, wherein the upper body portion comprises a partially cylindrical portion and a rib portion, and wherein the upper body portion includes a groove formed along the central longitudinal axis of at least a portion of the upper body portion; and a lower portion having a lower body portion, wherein the lower body portion includes a protrusion extending from at least a portion of the lower body portion, wherein the lower body portion comprises a front receiver lug recess and a rear receiver lug recess; wherein the groove of the upper body portion is formed so as to slidably mate with the protrusion of the lower portion, such that the upper body portion can be secured to the lower body portion via slidable interaction of the groove and the protrusion.

18 Claims, 9 Drawing Sheets

MULTI-PURPOSE GUNSMITHING FIXTURE

CROSS-REFERENCE TO RELATED APPLICATIONS

This application claims the benefit of U.S. Provisional Patent Application Ser. No. 61/204,762, filed Jan. 9, 2009, the entire disclosure of which is incorporated herein by reference.

BACKGROUND OF THE INVENTION

1. Field of the Invention

This invention relates generally to gunsmithing fixtures. In particular, the present invention relates to a multi-purpose gunsmithing fixture to aid in the proper and efficient assembly and/or modification of an AR15/M16 style upper receiver.

2. Description of Related Art

When assembling, repairing, or performing maintenance on the upper receiver of an AR15/M16 style rifle, it is important that the upper receiver be held firmly in place. The upper receiver is placed in a gunsmithing fixture while assembly, maintenance, or repair work is done on the upper receiver or its components. Typically, the fixture is then clamped into a standard bench vise.

Known gunsmithing fixtures for use with an AR15/M16 family of upper receivers are made in one of two types. The first type of fixture comprises a clamshell style fixture that is positioned around at least a portion of the upper receiver and then clamped in a bench vise.

The second type of fixture typically comprises a rectangular block style fixture having two recesses into which the lugs of the upper receiver can be positioned. The block style fixture has two sliding metal pins that lock the fixture to the upper receiver at the same points that the rifle's original takedown pins use. The bottom of fixture protrudes from below the upper receiver, providing a clamping area. Once the upper receiver lugs are positioned within the recesses, retaining pins are placed through the upper receiver lugs, just as the rifle's original takedown pins are, and the upper receiver is pinned to the fixture. The fixture can then be clamped in a bench vise.

SUMMARY OF THE INVENTION

Unfortunately, the known gunsmithing fixtures suffer from a number of drawbacks. If a clamshell style fixture is used, great care must be taken not to warp or crush the upper receiver when the clamshell fixture is secured in a vise. Because the clamshell style fixture surrounds the outside of the upper receiver, the external working portions of the upper receiver cannot be accessed when the clamshell fixture is used.

Because the block style fixture only secures the upper receiver by the upper receiver lugs, the amount of torque cannot be placed on the upper receiver without the danger of fracturing the lugs of the upper receiver and/or damaging the fixture itself.

Because the bolt assembly does not have to be removed from the upper receiver in order for the upper receiver to be engaged in or on the clamshell or block style fixture, it is possible to place a loaded upper receiver (and upper receiver still having an unfired round in its chamber) within the fixture.

The present invention relates generally to an improved, multi-purpose gunsmithing fixture that aids in the proper and efficient assembly and/or modification of an AR15/M16 type family of upper receivers.

The gunsmithing devise, or fixture, of this invention allows and upper receiver to be securely held, while the upper receiver or its components are built, maintained, or repaired. The fixture can be used to securely hold the upper receiver for repair or replacement of any and all items associated with the upper receiver itself, e.g., the barrel, the sights, the ejection port cover, and/or the forward assist. The fixture will also facilitate the mounting of optical sights and other devises.

In various exemplary, nonlimiting embodiments, the fixture of the present invention comprises two major components or parts. The first portion of the fixture is the lower portion that is designed so as to be secured in a vise or otherwise stabilized to provide a necessary stable work platform for low as well as high torque applications, such as, for example, barrel work. The second portion is the upper portion that is designed so as to secure the upper receiver to the lower portion of the improved gunsmithing fixture.

In various exemplary embodiments, the upper portion comprises a generally cylindrical object that is designed to interface, by means of an integrated track way, with the lower portion of the gunsmithing fixture. By placing the upper receiver onto the lower portion in the provided groove, the upper portion is then slid into the rear of the upper receiver, in the same manner as the rifle's bolt carrier group. The T-way in the upper portion directly aligns with the corresponding "T" in the lower portion. This action is very similar to a dovetail or tongue and groove.

It should be appreciated that the tolerances of the above-mentioned parts are sufficient to provide a strong, secure hold. A detent and spring combination, similar to the charging handle latch commonly found on this family of rifle, is used to secure the upper portion into the upper receiver, such that he fixture can be used in vertical applications (i.e., when the upper receiver is in a "muzzle up" orientation).

The use of this fixture also allows for consistent alignment of a vertical hole drilled thru the upper and lower portions designed for repair and replacement of the rear sight tensioning spring, as discussed herein. The upper and lower portions of this fixture interface in such a manner as to provide support to the entire upper receiver, without interfering with the external working portions of the rifle. This allows an operator, armorer, or gunsmith to work on the entire upper receiver safely and unhindered.

In various exemplary, nonlimiting embodiments, a rail is attached or formed as an integral portion of the underside of the lower portion. The rail, if included, is dimensionally identical to the Picatinny-style rail found on the top of the M4 style of upper receiver. This dimensional continuity will allow for the mounting, sighting, and/or alignment of optics, lasers, etc., which are designed to be utilized by the rifle, to be mounted safely, easily, and repeatedly on the fixture, without need for the host rifle.

In addition, the rail allows for repair or modification of the M4 style removable sight/carry handle. This also directly corresponds with the previously mentioned vertical hole designed to interface with the M4 removable sight tension spring. To utilize the rail feature the lower portion of the fixture will be mounted into the vise (or other stabilizing devise) bottom-side up.

It should be understood that a specific dimensions of the components of the gunsmithing fixture are dictated by the dimensions of the source rifle, i.e., the AR15/M16 rifle. This rifles system, in its many and varied guises, has been in existence in the area of 50 years. While the upper receiver has undergone several exterior design changes in recent history, the interior dimensions have remained substantially unchanged for the life of this rifle. It should be appreciated that dimensions of the components of the fixture of this invention are based upon the dimensions of the interior of the upper receiver and the distance between the upper receiver lugs designed to mate the upper and lower receiver.

The dimensions of the body, or lower portion, of the gunsmithing fixture are relative to the dimensions of the upper receiver only so far as they are necessary to allow for proper placement and location of the working parts of the upper receiver. The expansion, contraction, addition, and/or subtraction of surface area, especially with regard to the height and width of the lower portion of the fixture are subject to change relative to materials, strengths, and design changes.

The other pertinent dimensions of the gunsmithing fixture are relative to the rail found on the bottom of the lower portion. These dimensions are to be consistent with the industry standards of the M4 style of upper receiver. This will allow proper placement of scopes and accessories, as well as the proper alignment required to repair or replace the rear sight tension spring of a detachable carry handle. The slots on the rail may or may not be numbered to correspond with the current markings offered in the industry.

Accordingly, this invention provides a gunsmithing fixture that is designed to be used to aid in the proper and efficient assembly and/or modification of an AR15/M16 style upper receiver.

This invention separately provides a gunsmithing fixture that can be utilized for repair or replacement of all items associated with an AR15/M16 style upper receiver.

This invention separately provides a gunsmithing fixture that can be utilized with A2 (carry handle), A3 (flat-top), A4 (M4), or any other variation or upper receiver for the AR15/M16 family of rifle.

This invention separately provides a gunsmithing fixture that offers improved protection for the upper receiver while assembling, repairing, or performing maintenance on the upper receiver.

This invention separately provides a gunsmithing fixture that allows access to the external working portions of the receiver, while the receiver is attached to the fixture.

This invention separately provides a gunsmithing fixture that will accommodate most handguard configurations without modification to the fixture.

This invention separately provides a gunsmithing fixture that provides a proper clamping position for barrel installation and/or removal.

This invention separately provides a gunsmithing fixture that can be used at an upper end of the torque range necessary to properly install components on the upper receiver.

This invention separately provides a gunsmithing fixture having a bottom portion that can be used independently for scope and other installations and/or alignments.

This invention separately provides a gunsmithing fixture that, by virtue of the requirement that the bolt and bolt assembly be removed from the upper receiver prior to use of the fixture, is inherently safer than known gunsmithing fixtures.

These and other features and advantages of this invention are described in or are apparent from the following detailed description of the exemplary embodiments.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF EXEMPLARY EMBODIMENTS

Figure 1:
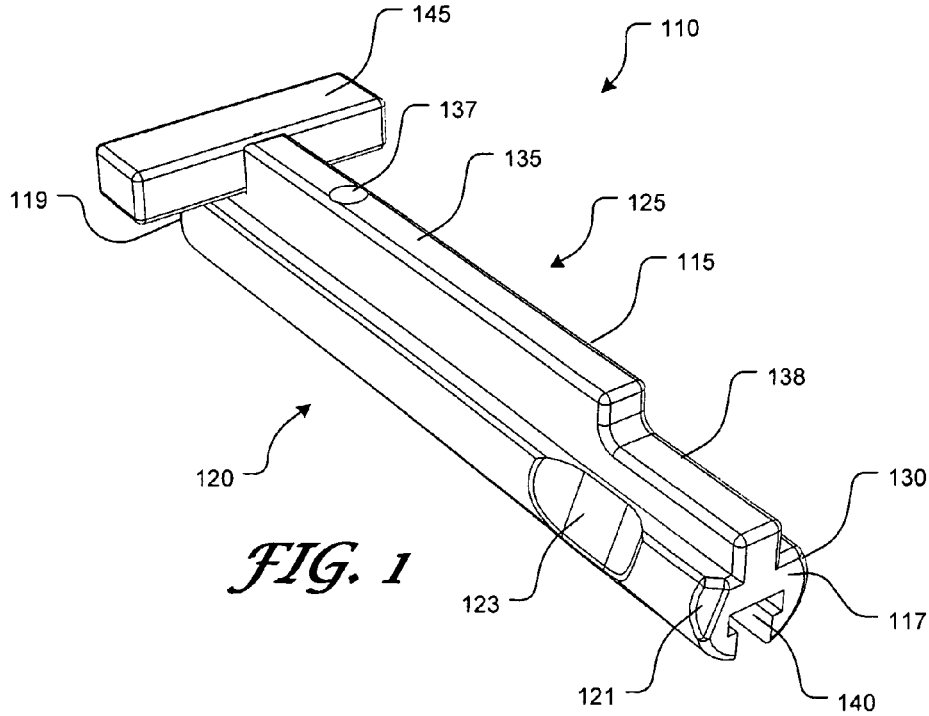
FIG. 1 shows a front perspective view of the upper portion of a first exemplary embodiment of a gunsmithing fixture according to this invention.
Figure 2:
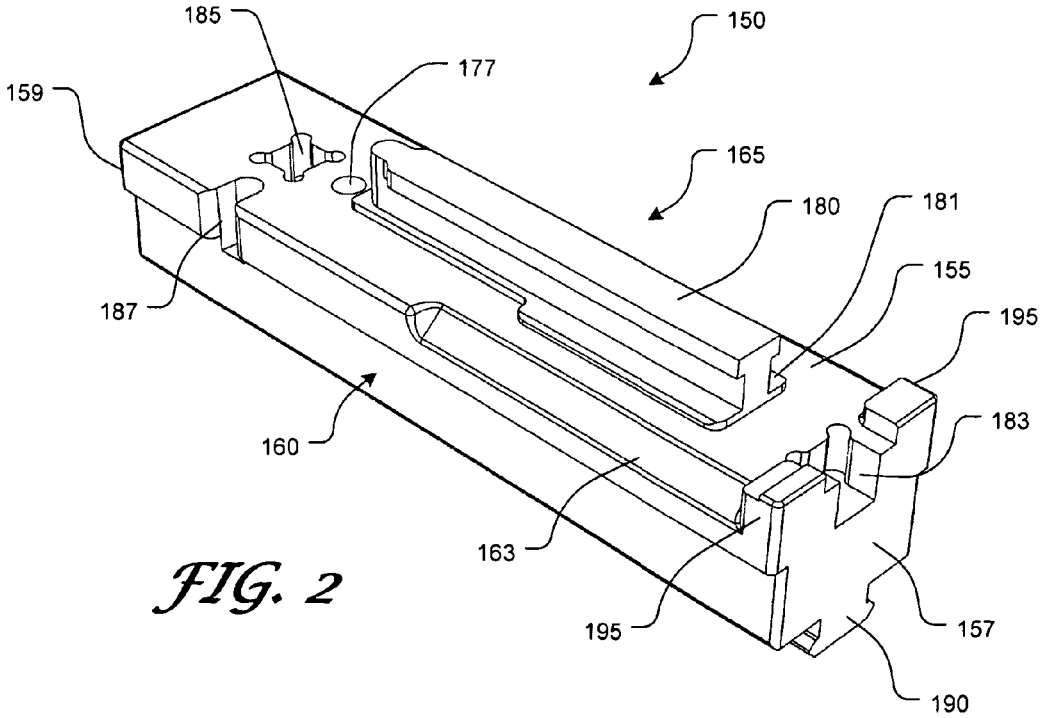
FIG. 2 shows a front perspective view of the lower portion of a first exemplary embodiment of a gunsmithing fixture according to this invention.
Figure 3:
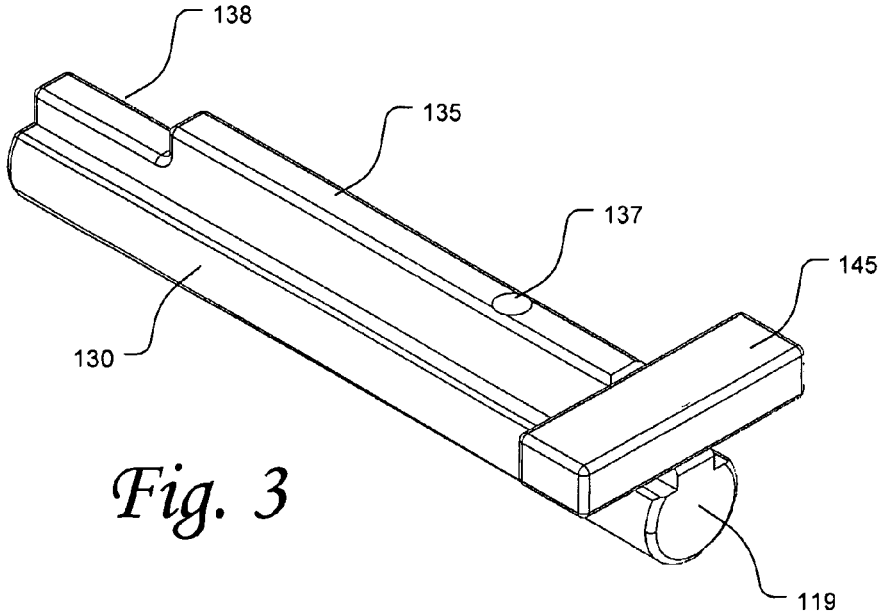
FIG. 3 shows a rear perspective view of the upper portion of a first exemplary embodiment of a gunsmithing fixture according to this invention.
Figure 4:
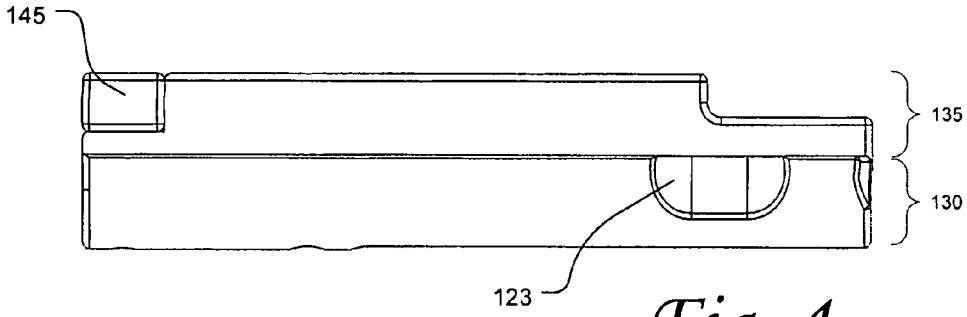
FIG. 4 shows a right side view of the upper portion of a first exemplary embodiment of a gunsmithing fixture according to this invention.
Figure 5:
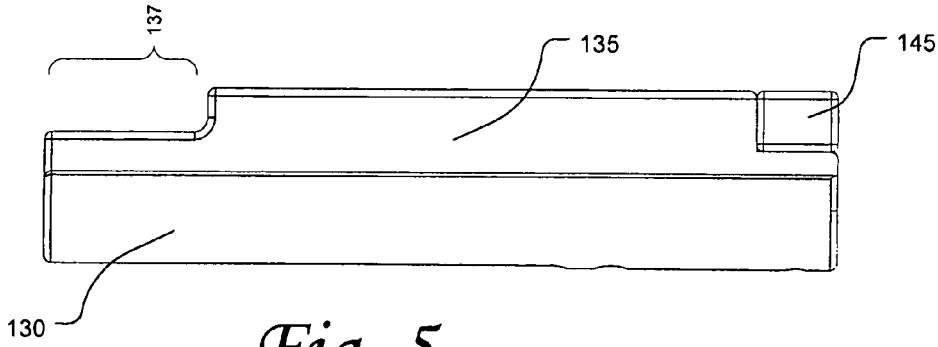
FIG. 5 shows a left side view of the upper portion of a first exemplary embodiment of a gunsmithing fixture according to this invention.
Figure 6:
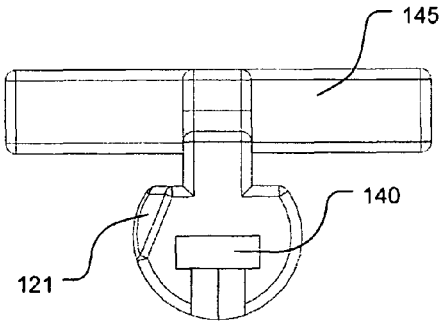
FIG. 6 shows a front view of the upper portion of a first exemplary embodiment of a gunsmithing fixture according to this invention.
Figure 7:
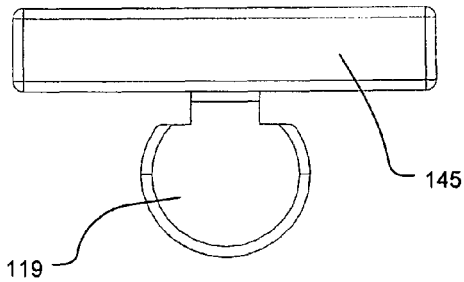
FIG. 7 shows a rear view of the upper portion of a first exemplary embodiment of a gunsmithing fixture according to this invention.
Figure 8:
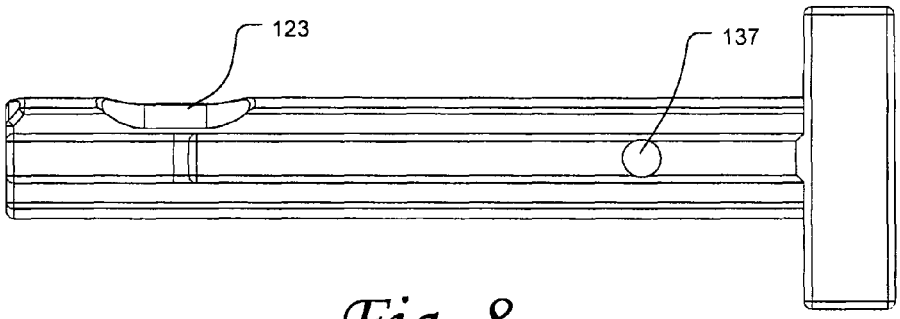
FIG. 8 shows a top view of the upper portion of a first exemplary embodiment of a gunsmithing fixture according to this invention.
Figure 9:
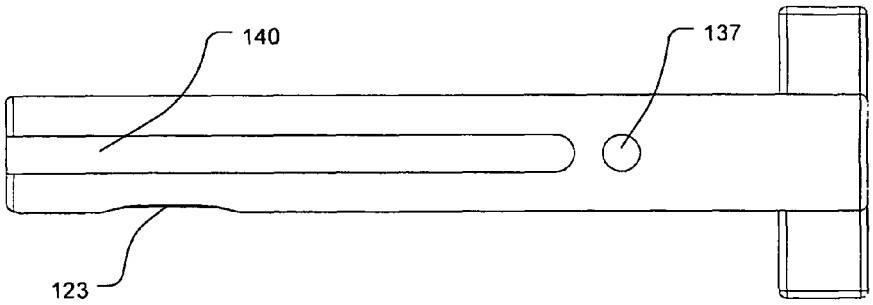
FIG. 9 shows a bottom view of the upper portion of a first exemplary embodiment of a gunsmithing fixture according to this invention.

For simplicity and clarification, the design factors and operating principles of the gunsmithing fixture of this invention are explained with reference to various exemplary embodiments of a gunsmithing fixture according to this invention. The basic explanation of the design factors and operating principles of the gunsmithing fixture is applicable for the understanding, design, and use of the gunsmithing fixture of this invention.

It should be appreciated that the terms "gunsmithing fixture" and "upper receiver" are used for basic explanation and understanding of the systems, methods, and/or apparatuses of this invention. Therefore, the terms "gunsmithing fixture" and "upper receiver" are not to be construed as limiting the systems, methods, and apparatuses of this invention.

It should also be appreciated that while the various exemplary embodiments of the present invention are described and shown as being utilized in connection with the upper receiver of an AR15/M16, they should not be construed as limiting the usage of the present invention. Thus, it should be understood that the gunsmithing fixture of the present invention can be utilized in connection with an upper receiver for any AR15/M16 style of rifle as well as any upper receiver for any other type of rifle.

It should be understood that the absence of specific detail regarding the techniques used to assemble the various components of the upper receiver is intentional as the gunsmithing fixture is designed to be utilized with a wide variety and combination of assembly techniques and methods that are known to those of ordinary skill in the art.

With regard to certain of the dimensions of the fixture illustrated in the drawing Figs., it should be appreciated that the dimensions can be determined by careful and accurate measurement of an appropriate upper receiver or by following detailed blueprints of an upper receiver that may be available in the industry. Any dimensions discussed and/or illustrated, however, should be sufficient to allow a full scale, functional devise to be manufactured with little or no modifications required for final production models and are not intended to limit the present invention.

Turning now to the drawing figures, FIGS. 1 and 3-9 show a front perspective, rear perspective, right side, left side, front, rear, top, and bottom view, respectively, of the upper portion 110 of the gunsmithing fixture 100, while FIGS. 2 and 12-18 show a front perspective, rear perspective, right side, left side, front, rear, top, and bottom view, respectively, of the lower portion 150 of the fixture 100, according to this invention.

Figure 22:
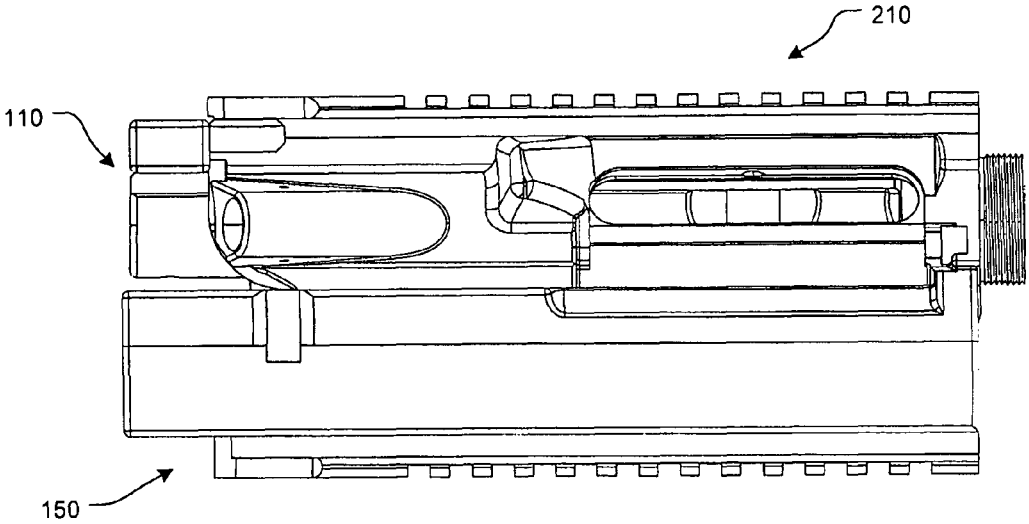
FIG. 22 shows a right side view of a generic upper receiver secured to a first exemplary embodiment of a gunsmithing fixture according to this invention.
Figure 23:
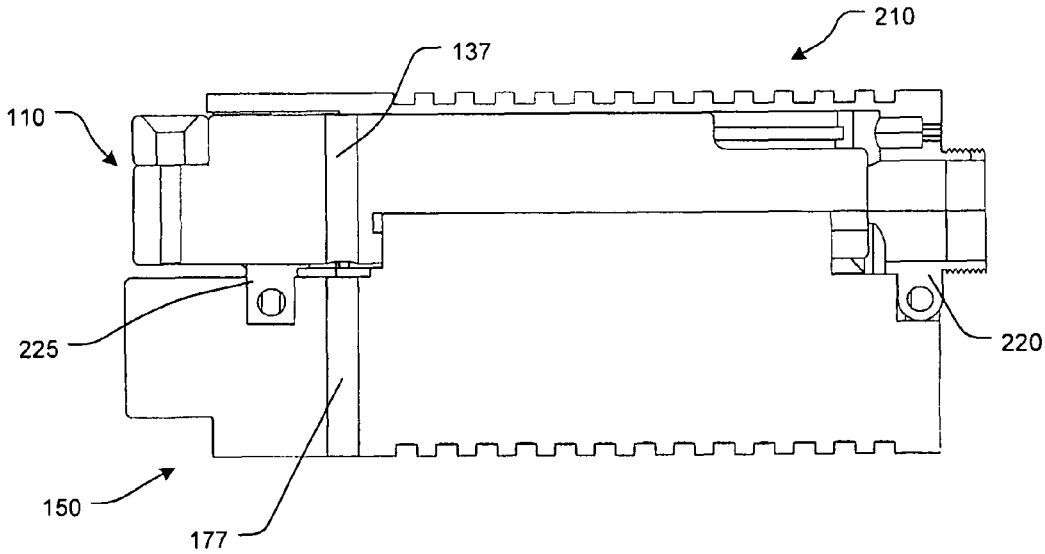
FIG. 23 shows a right side cutaway view of a generic upper receiver secured to a first exemplary embodiment of a gunsmithing fixture according to this invention.

As illustrated in FIGS. 1 and 3-9, the upper portion 110 includes an upper body portion 115 that extends from a front end 117 to a rear end 119 and has a right side 120 and a left side 125. In various exemplary embodiments, the overall length of the upper body portion 115 from the front end 117 to the rear end 119 is approximately that of an AR15/M16 bolt carrier. Alternatively, the overall length of the upper body portion may be such that, when an upper receiver 210 is secured to the fixture 100, as illustrated in FIGS. 22 and 23, the upper body portion 115 is recessed from a barrel receiving area and the barrel nut threads 240 of an attached upper receiver 210, but extends beyond the rear portion of the upper receiver 210. A generic upper receiver 210 is illustrated in FIGS. 19A-19E and FIGS. 22-23. It should be appreciated that the generic upper receiver 210 is intended to be illustrative, and should not be construed as limiting the usage of the present invention.

In various exemplary embodiments, the upper body portion 115 has an overall shape similar to that of a combined AR15/M16 bolt carrier and charging handle and comprises at least some of a partially cylindrical portion 130 and a rib portion 135. The partially cylindrical portion 130 is shaped so as to substantially fill the area of the upper receiver 210 that is formed to receive the bolt carrier (without the bolt carrier key) of an AR15/M16.

The rib portion 135 extends upward along the longitudinal axis of the partially cylindrical portion 130. The rib portion 135 includes a rib relief area 138 proximate the front end 117. The rib portion 135 and rib relief area 138 are shaped so as to substantially fill the area of the upper receiver 210 that is formed to receive the combined AR15/M16 bolt carrier and charging handle.

Therefore, it should be appreciated that the upper body portion 115 is shaped so as to substantially fill the inner cavity of the upper receiver 210 that is formed to receive an assembled bolt carrier of an AR15/M16 (including the bolt carrier and bolt carrier key), when the assembled bolt carrier is fitted within a charging handle.

As shown in FIGS. 1 and 3-9, a "T" handle portion 145 extends on either side of the rib portion 135. The "T" handle portion 145 a shaped similarly to the "T" handle portion of a bolt carrier charging handle and is included to aid in the insertion and/or removal of the upper portion 110 in the inner cavity of the upper receiver 210.

Figure 10:
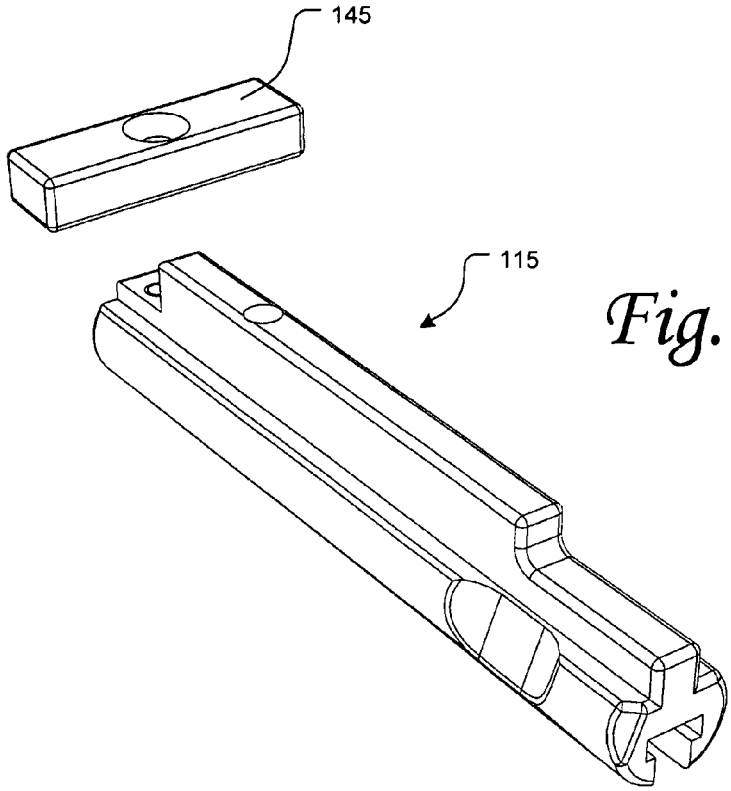
FIG. 10 shows a first front perspective view of a second exemplary embodiment of an upper portion of a gunsmithing fixture, according to this invention.
Figure 11:
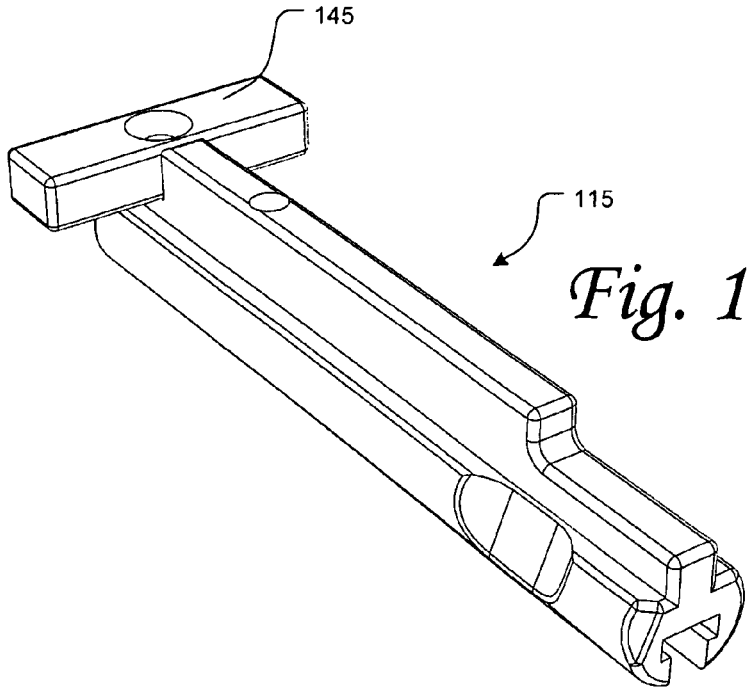
FIG. 11 shows a second front perspective view of a second exemplary embodiment of an upper portion of a gunsmithing fixture, according to this invention.
Figure 12:
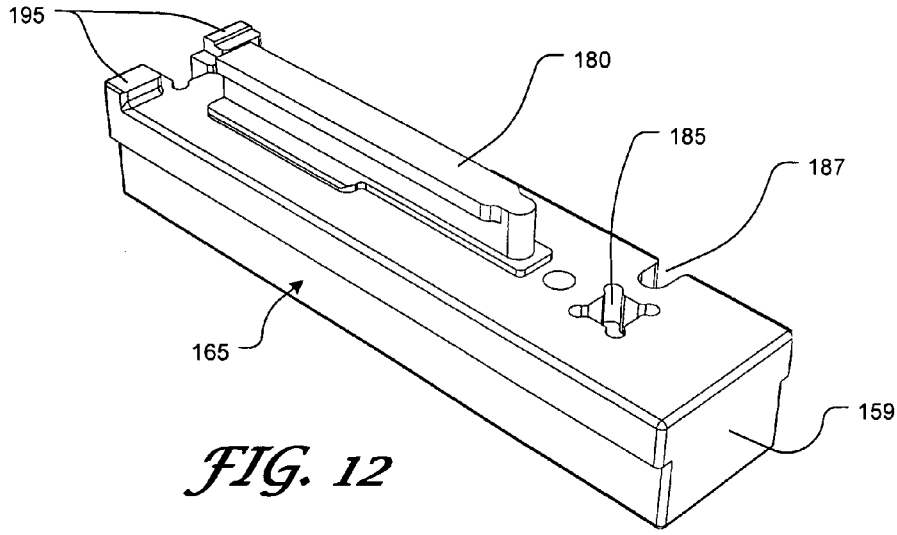
FIG. 12 shows a rear perspective view of the lower portion of a first exemplary embodiment of a gunsmithing fixture according to this invention.
Figure 13:
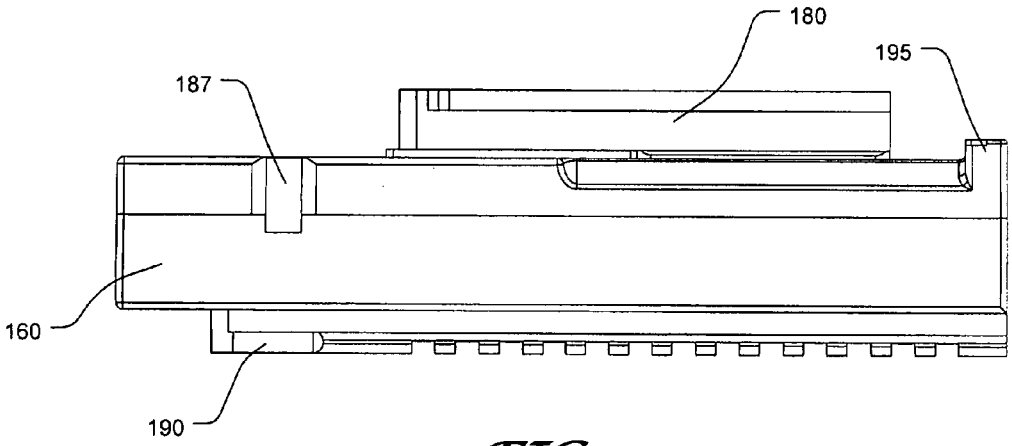
FIG. 13 shows a right side view of the lower portion of a first exemplary embodiment of a gunsmithing fixture according to this invention.
Figure 14:
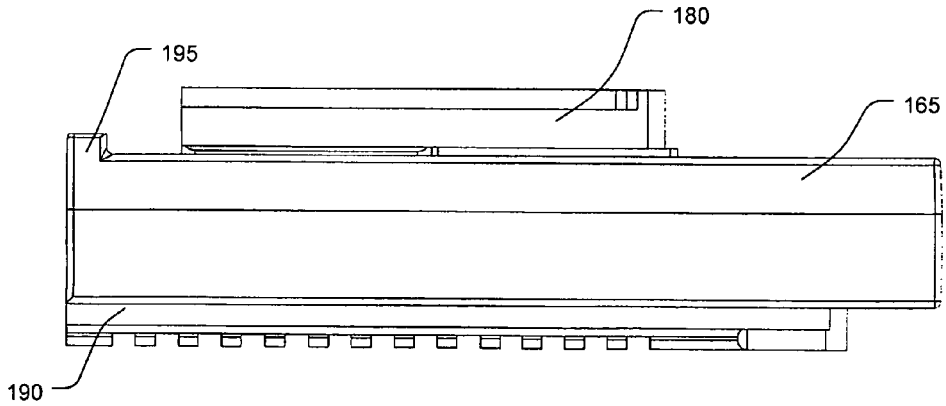
FIG. 14 shows a left side view of the lower portion of a first exemplary embodiment of a gunsmithing fixture according to this invention.
Figure 15:
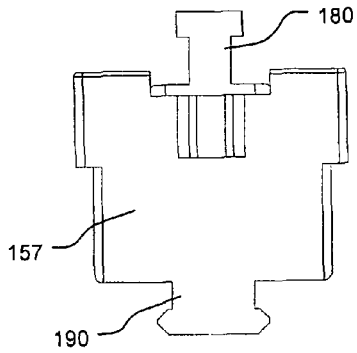
FIG. 15 shows a front view of the lower portion of a first exemplary embodiment of a gunsmithing fixture according to this invention.
Figure 16:
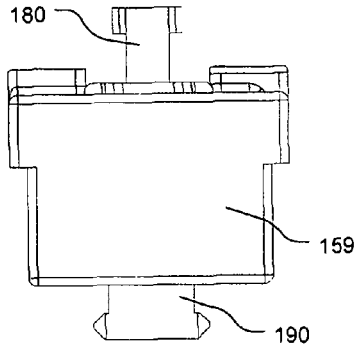
FIG. 16 shows a rear view of the lower portion of a first exemplary embodiment of a gunsmithing fixture according to this invention.
Figure 17:
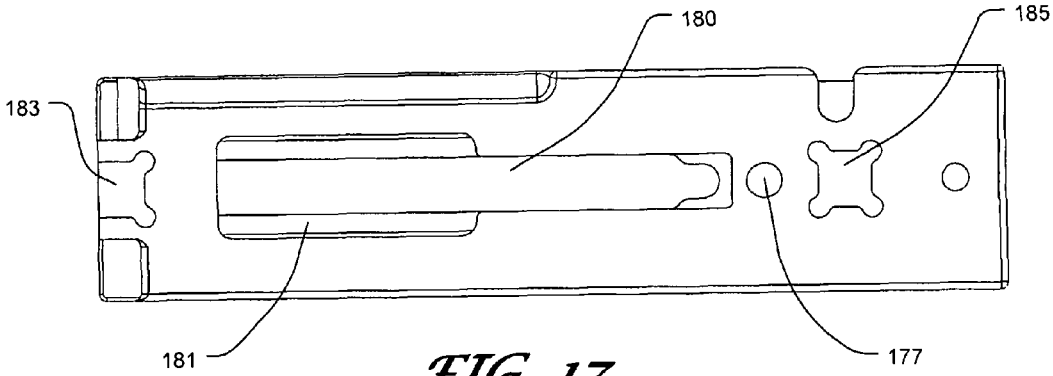
FIG. 17 shows a top view of the lower portion of a first exemplary embodiment of a gunsmithing fixture according to this invention.
Figure 18:
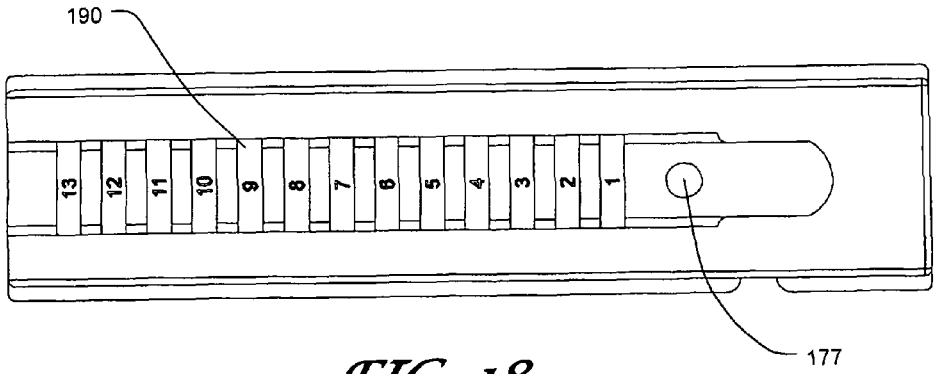
FIG. 18 shows a bottom view of the lower portion of a first exemplary embodiment of a gunsmithing fixture according to this invention.

As shown in FIGS. 1 and 3-9, the "T" handle portion 145 is formed as an integral component of the upper body portion 115. Alternatively, as shown in FIGS. 10 and 11, a "T" handle portion 147 may comprise a separate component that is permanently or removably affixed, attached, or coupled to the upper body portion 115.

It should be appreciated that come in various exemplary embodiments, the "T" handle portion 145 may include a latch mechanism similar to that found on any charging handle. If included, the latch mechanism would allow the upper portion 110 to be positively latched to the upper receiver 210, when fully seated within the upper receiver 210.

A front bevel 121 is formed along at least the leading edge of the right side 120 of the partially cylindrical portion 130. The front bevel 121 is designed to unlock, or open, the ejection port cover of the upper receiver 210 if the ejection port cover is in the closed position when the upper portion 110 is inserted into the inner cavity of the upper receiver 210. In various exemplary embodiments, the front bevel 121 is located proximate the location of the ejection port cover internal components and has a slight rearward taper that is dimensionally flexible.

In certain exemplary embodiments, the left side 125 of the partially cylindrical portion 130 does not include a corresponding front bevel. In other exemplary embodiments, the partially cylindrical portion 130 includes a mirror image front bevel formed in the left side 125, so that the upper portion 110 can be utilized in connection with the upper receiver 210 having an ejection port located on its left side. Therefore, the partially cylindrical portion 130 may include a front bevel on one or both of its sides so that the upper portion 110 can be utilized in connection with the upper receiver 210 having an ejection port located on its right or left side.

In various exemplary embodiments, an ejection port relief 123 is formed along the right side 120 of the upper body portion 115. The ejection port relief 123 is approximately dimensionally equivalent to that of an ejection port relief of a bolt carrier, such that the ejection port cover can be closed when the upper portion 110 is fully inserted into the upper receiver 210. If the ejection port cover is closed when the upper portion 110 is fully inserted into the upper receiver 210, the ejection port relief 123 will push open the ejection port cover as the upper portion 110 is removed from within the inner cavity of the upper receiver 210.

In certain exemplary embodiments, the left side 125 of the upper body portion 115 does not include a corresponding ejection port relief. In other exemplary embodiments, the upper portion 110 includes a mirror image ejection port relief formed in the left side 125, so that the upper portion 110 can be utilized in connection with the upper receiver 210 having an ejection port located on its left side. Therefore, the upper body portion 115 may include an ejection port relief on one or both of its sides so that the upper portion 110 can be utilized in connection with the upper receiver 210 having an ejection port located on its right or left side.

In certain exemplary embodiment, an upper sight aperture 137 is formed vertically, through the upper portion 110, perpendicular to the longitudinal axis of the upper portion 110. The upper sight aperture 137, if included, allows a user to access a rear sight tension spring, if included on the upper receiver 210.

In order for the upper portion 110 to be slidably attached to the lower portion 150, the upper portion 110 and the lower portion 150 include at least one sliding protrusion and groove arrangement. As illustrated herein, the upper portion 110 includes a groove, in the form of a T-shaped groove 140, formed along the central longitudinal axis of at least a portion of the upper body portion 115 and the lower portion 150 includes a slidably mating protrusion, in the form of a T-shaped protrusion 180, extending from the central longitudinal axis of at least a portion of the lower portion 150.

As illustrated in FIGS. 2 and 12-18, the lower portion 150 includes a lower body portion 155 that extends from a front end 157 to a rear end 159 and has a right side 160 and a left side 165. In various exemplary embodiments, the overall length of the lower body portion 155 from the front end 157 to the rear end 159 is greater than that of an AR15/M16 upper receiver 210.

It should be appreciated that the rear end 159 of the lower body portion 155 can easily be elongated to provide additional area for the inclusion of additional features. For example, the rear and 159 may be elongated to allow for cantilevering of the fixture 100 or so as to provide a "punch block".

It should also be appreciated that the height of the lower body portion 155 can also be modified, so long as the lower body portion 155 is of a sufficient size and shape to allow the lower body portion 155 of the lower portion 150 to be secured, for example, within a vise. Alternatively, the lower body portion 155 may be formed so as to be independently secured to a surface, such as, for example, the top of a workbench, or another fixture or structure.

The lower body portion 155 includes a front receiver lug recess 183. The front receiver lug recess 183 generally comprises a slot cut so as to allow the front upper receiver lug 220 of the upper receiver 210 to be positioned at least partially within the front receiver lug recess 183, when the upper receiver 210 is seated atop the lower portion 150. In various exemplary embodiments, the front receiver lug recess 183 is formed such that a forward portion of the front upper receiver lug 220 extends beyond the front end 157, when the upper receiver 210 is seated atop the lower portion 150. By allowing at least a portion of the upper receiver lug to be exposed when the upper receiver 210 is secured to the fixture 100, it is ensured that the fixture 100 will accommodate most handguards so that a handguards can be installed on the upper receiver 210 (or components thereof) while the upper receiver 210 is secured to the fixture 100, without further modification to the fixture 100.

The rear receiver lug recess 185 generally comprises an aperture formed so as to allow the rear upper receiver lug 225 to be received into the rear receiver lug recess 185 when the upper receiver 210 is seated atop the lower portion 150. In certain exemplary embodiments, the rear receiver lug recess 185 is approximately 0.5 of an inch square. The rear receiver lug recess 185 is formed so as to closely approximate the actual dimensions of the rear upper receiver lug 225, allowing the rear upper receiver lug 225 to fit snugly into the rear receiver lug recess 185.

In various exemplary embodiments, an ejection port cover relief area 163 is formed along the right side 160 of the lower body portion 155. The ejection port cover relief area 163 is a relief cut area, cut at approximately 45 degrees, so as to allow for the full opening of the ejection port cover of the upper receiver 210. In the fully opened position, the ejection port cover is easier to repair or replace.

In certain exemplary embodiments, the left side 165 of the lower body portion 155 does not include a corresponding ejection port cover relief area. In other exemplary embodiments, the lower portion 150 includes a mirror image ejection port cover relief area formed in the left side 165, so that the lower portion 150 can be utilized in connection with the upper receiver having an ejection port located on its left side. Therefore, the lower body portion 155 may include an ejection port cover relief area on one or both of its sides so that the lower portion 150 can be utilized in connection with the upper receiver having an ejection port located on its right or left side.

Figure 20:
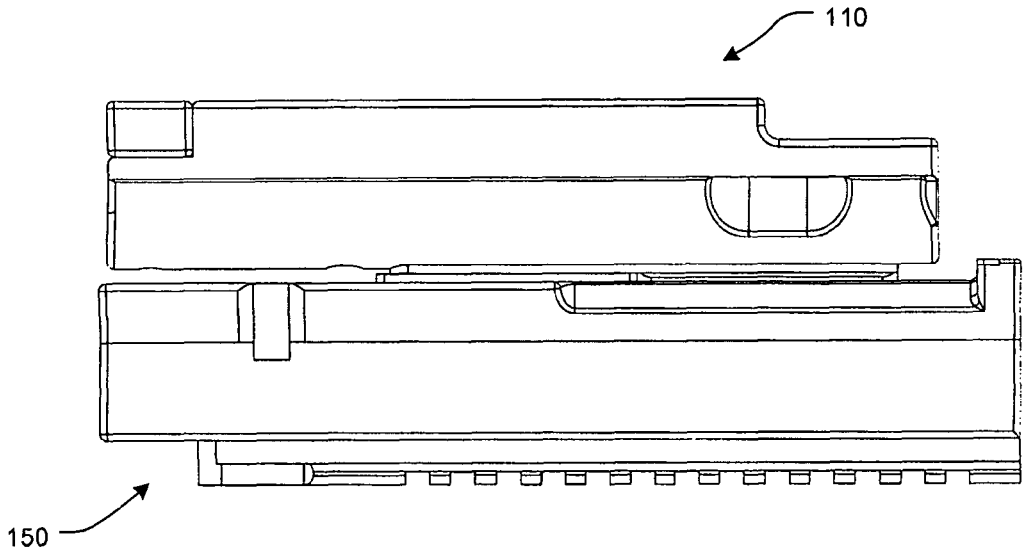
FIG. 20 shows a right side view of the upper portion secured to the lower portion of a first exemplary embodiment of a gunsmithing fixture according to this invention.
Figure 21:
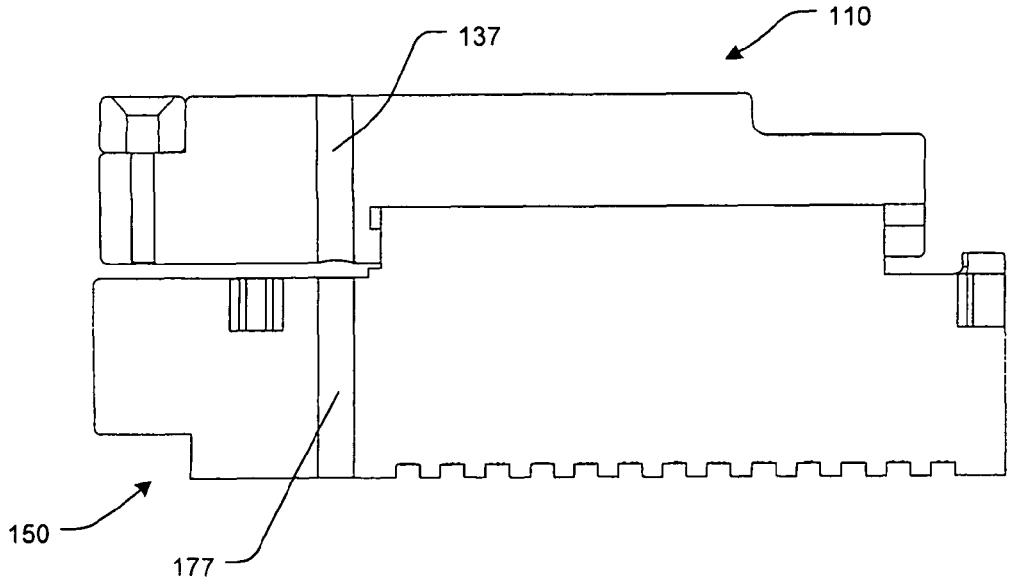
FIG. 21 shows a right side cutaway view of the upper portion secured to the lower portion of a first exemplary embodiment of a gunsmithing fixture according to this invention.

In certain exemplary embodiment, a lower sight aperture 177 is formed vertically, through the lower portion 150, perpendicular to the longitudinal axis of the lower portion 150. The lower sight aperture 177, if included, is aligned with the upper sight aperture 137 when the upper portion 110 is fully slidably attached to the lower portion 150, as illustrated in FIGS. 20 and 21. The alignment of the lower sight aperture 177 with the upper sight aperture 137 allows a user to access a rear sight tension spring, if included on the upper receiver 210.

In various exemplary embodiments, the lower body portion 155 also includes a forward assist retaining pin recess 187. If included, the retaining pin recess 187 comprises a slot designed to allow for removal of the forward assist retaining pin of the upper receiver 210, while the upper receiver 210 is secured to the gunsmithing fixture 100.

In certain exemplary embodiments, anti-torsion walls 195 extend upward from the lower body portion 155 adjacent the front end 157. The raised, anti-torsion walls 195 are designed to support the outside of the upper receiver 210 and give anti-torsion support to the upper receiver 210 during high-torque applications. The exact size and shape of the optional anti-torsion walls 195 will be dictated by the exterior dimensions of the upper receiver 210.

A rail feature 190 may be included along the bottom of the lower body portion 155. In various exemplary embodiments, the rail feature 190 is an exact replica of the rail found on the top of the M4 style, flat top, upper receiver. The rail feature 190 may optionally be formed as an integral part of the lower body portion 155 (as illustrated) or may comprise a separate component that is attached, coupled, or otherwise secured to the bottom of the lower body portion 155.

In order for the upper portion 110 to be slidably attached to the lower portion 150, the lower portion 150 includes a mating protrusion, in the form of a T-shaped protrusion 180 extending from the central longitudinal axis of at least a portion of the upper lower portion 150.

In certain exemplary embodiments, the T-shaped protrusion 180 intersects with the lower body portion 155 in a wider, raised area 181. If included, the raised area 181 may be approximately 0.25 of an inch in height. This raised area 181 is designed to fit into the existing recessed area of the upper receiver 210.

It should be appreciated that while the sliding protrusion and groove of arrangement that operates to slidably attach the upper portion 110 to the lower portion 150 is illustrated as comprising a T-shaped groove 140 and a T-shaped protrusion 180, the actual shape of the protrusion and groove of arrangement can be any chosen arrangement that allows the upper portion 110 to be slidably attached to the lower portion 150, including, for example, any dovetail type arrangement of protrusion and tale.

It should be appreciated that any material that is capable of dimensional stability and durability can be utilized to construct the components of the gunsmithing fixture 100. In various exemplary embodiments, various portions of the gunsmithing fixture 100 are formed of a plastic or polymeric material, such as a polymeric composite or a high strength plastic such as DELRIN. Alternate materials of construction may include one or more of the following: wood, steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass or polymer fiber reinforced plastics, thermoform and/or thermoset sheet materials, and/or various combinations of the foregoing.

Due to the nature of the work and stresses involved, the material should be sufficiently strong and durable as allow for longevity and tolerance. Any and all natural and man-made materials able to meet the criterion would be considered for application. Thus, it should be understood that the material or materials used to form the components of the gunsmithing fixture 100 or various portions of the components of the gunsmithing fixture 100 is a design choice based on the desired appearance and/or functionality of the gunsmithing fixture 100.

As illustrated in FIGS. 19A-23, during use of the fixture 100, the upper receiver 210 is initially placed upon the lower portion 150, such that the front upper receiver lug 220 is fitted with in the front receiver lug recess 183 and the rear upper receiver lug 225 is fitted into the rear receiver lug recess 185.

Figures 19A, 19B, 19C, 19D, 19E:
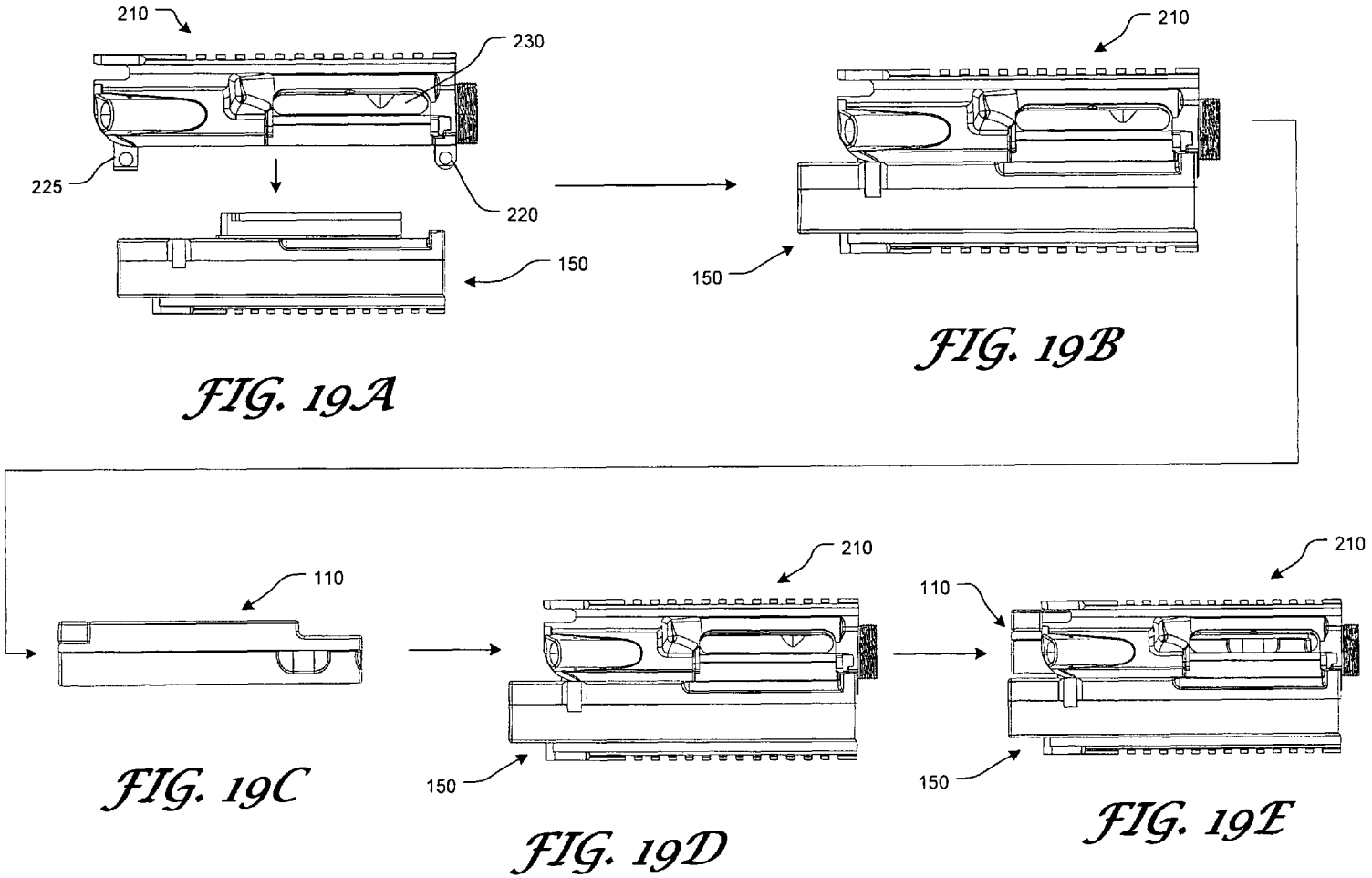
FIGS. 19A-19E illustrate the exemplary use of the fixture in connection with a generic upper receiver.

Once the upper receiver 210 is placed upon the lower portion 150, as illustrated in FIGS. 19A and 19B, the upper portion 110, as illustrated in FIG. 19C, can be slidably positioned into the inner cavity of the upper receiver 210, such that the T-shaped groove 140 slidably engages the T-shaped protrusion 180.

As illustrated in FIGS. 19E-23, once the upper portion 110 is fully seated within the inner cavity of the upper receiver 210, by means of the interaction between the T-shaped groove 140 and the T-shaped protrusion 180, the fixture 100, and more particularly the lower body portion 155, can be secured or otherwise stabilized so as to allow assembly, modification, or maintenance work to be performed on the upper receiver 210.

The design of the AR15/M16 was based on a dimensionally larger rifle known as the AR-10. The AR-10, currently produced by ArmaLite, Inc. is primarily in caliber 7.62 mm (.308 Winchester) but is not limited to this caliber. Thus, at least certain dimensions of the gunsmithing fixture 100 can be expanded or otherwise modified such that a dimensionally modified version of the gunsmithing fixture 100 can be utilized in connection with the upper receiver of an AR-10. Other rifles of similar design and build, such as the SR25, etc., are currently available within the industry. The fixture 100 can be modified accordingly to support all of these rifles.

It should be understood that the absence of specific detail regarding the dimensioning required to modify the fixture 100 to be used with such similar rifles is intentional as such dimensional and other requirements will be apparent to those skilled in the art and because the exact dimensions of the various components of the gunsmithing fixture of the present invention are design choice based upon the desired compatibility and functionality of the gunsmithing fixture.

While this invention has been described in conjunction with the exemplary embodiments outlined above, it is evident that many alternatives, modifications, and variations will be apparent to those skilled in the art. Any and all such adaptations, modifications, and variations should and are intended to be comprehended within the meaning and range of equivalents of the disclosed exemplary embodiments.

It is to be understood that the phraseology of terminology employed herein is for the purpose of description and not of limitation. Accordingly, the foregoing description of the exemplary embodiments of the invention, as set forth above, are intended to be illustrative, not limiting. Various changes, modifications, and/or adaptations may be made without departing from the spirit and scope of this invention.

What is claimed is:

1. A gunsmithing fixture for use with an upper receiver, the upper receiver having an inner cavity and an ejection port, comprising:

an upper portion having an upper body portion that extends from a front end to a rear end and having a right side and a left side, wherein the upper body portion comprises a partially cylindrical portion and a rib portion, wherein the rib portion extends upward along a longitudinal axis of the partially cylindrical portion, wherein the upper body portion comprises a "T" handle portion that extends from either side of the rib portion of the upper body portion, and wherein the upper body portion includes a groove formed along a central longitudinal axis of at least a portion of the upper body portion; and a lower portion having a lower body portion that extends from a front end to a rear end and having a right side and a left side, wherein the lower body portion includes a protrusion extending from the central longitudinal axis of at least a portion of the lower body portion, wherein the lower body portion comprises a front receiver lug recess and a rear receiver lug recess;

wherein the groove of the upper body portion is formed so as to slidably mate with the protrusion of the lower portion, such that the upper body portion can be secured to the lower body portion via slidable interaction of the groove and the protrusion.

2. The gunsmithing fixture of claim 1, wherein the upper body portion is shaped so as to substantially fill the inner cavity of the upper receiver.

3. The gunsmithing fixture of claim 1, wherein the upper body portion has an overall shape similar to that of a combined bolt carrier and charging handle.

4. The gunsmithing fixture of claim 1, wherein the partially cylindrical portion is shaped so as to substantially fill the area of the upper receiver that is formed to receive a bolt carrier.

5. The gunsmithing fixture of claim 1, wherein the rib portion includes a rib relief area proximate the front end of the upper body portion.

6. The gunsmithing fixture of claim 1, wherein the rib portion and rib relief area are shaped so as to substantially fill the area of the upper receiver that is formed to receive a combined AR15/M16 bolt carrier and charging handle.

7. The gunsmithing fixture of claim 1, wherein the "T" handle portion is formed as an integral component of the upper body portion.

8. The gunsmithing fixture of claim 1, wherein the "T" handle portion comprises a separate component that is permanently or removably affixed, attached, or coupled to the upper body portion.

9. The gunsmithing fixture of claim 1, further comprising a front bevel formed in a side of the partially cylindrical portion.

10. The gunsmithing fixture of claim 1, further comprising an upper sight aperture formed through the upper portion, perpendicular to a longitudinal axis of the upper portion, and a lower sight aperture formed through the lower portion, perpendicular to the longitudinal axis of the lower portion, such that, when the upper body portion is secured to the lower body portion, the upper sight aperture is aligned with the lower sight aperture.

11. The gunsmithing fixture of claim 1, wherein the groove is in the form of a T-shaped groove.

12. The gunsmithing fixture of claim 1, wherein the protrusion is in the form of a T-shaped protrusion.

13. The gunsmithing fixture of claim 1, wherein the front receiver lug recess comprises a slot formed so as to allow a front upper receiver lug of the upper receiver to be positioned at least partially into the front receiver lug recess and the rear receiver lug recess comprises an aperture formed so as to allow a rear upper receiver lug of the upper receiver to be received into the rear receiver lug recess.

14. The gunsmithing fixture of claim 1, further comprising an ejection port cover relief area formed in a side of the lower body portion.

15. The gunsmithing fixture of claim 1, further comprising a forward assist retaining pin recess formed in the lower body portion.

16. The gunsmithing fixture of claim 1, further comprising anti-torsion walls extending upward from the lower body portion, adjacent the front end of the lower portion, wherein the anti-torsion walls are capable of providing support to a portion of an outside surface of the upper receiver.

17. The gunsmithing fixture of claim 1, further comprising a rail feature included along a bottom of the lower body portion.

18. The gunsmithing fixture of claim 1, further comprising a rail feature formed as an integral part of a bottom of the lower body portion.

* * * * *